US012372017B2

(12) United States Patent
Krüger et al.

(10) Patent No.: US 12,372,017 B2
(45) Date of Patent: Jul. 29, 2025

(54) EXHAUST GAS TREATMENT ASSEMBLY

(71) Applicant: Purem GmbH, Neunkirchen (DE)

(72) Inventors: Gregor Krüger, Leipzig (DE); Matthias Kauer, Coswig (DE); Frank Glaser, Dresden (DE); Kirill Karelin, Boeblingen (DE); Shengxiao Lin, Esslingen (DE); Peter Kast, Esslingen (DE)

(73) Assignee: Purem GmbH, Neunkirchen (DE)

( * ) Notice: Subject to any disclaimer, the term of this patent is extended or adjusted under 35 U.S.C. 154(b) by 254 days.

(21) Appl. No.: 18/057,089

(22) Filed: Nov. 18, 2022

(65) Prior Publication Data

US 2023/0160327 A1 May 25, 2023

(30) Foreign Application Priority Data

Nov. 19, 2021 (DE) ..... 10 2021 130 261.7

(51) Int. Cl.
*F01N 3/021* (2006.01)

(52) U.S. Cl.
CPC ..... *F01N 3/0211* (2013.01); *F01N 2330/02* (2013.01); *F01N 2450/24* (2013.01); *F01N 2450/30* (2013.01)

(58) Field of Classification Search
CPC ..... F01N 13/1805; F01N 13/1844; F01N 13/1855; F01N 13/1894; F01N 2330/02; F01N 2450/22; F01N 2450/24; F01N 2450/30; F01N 2470/22; F01N 3/0211
See application file for complete search history.

(56) References Cited

U.S. PATENT DOCUMENTS 9,140,154 B2 * 9/2015 Mitsuda ..... F01N 13/1855
2005/0077104 A1 * 4/2005 Flintham ..... F01N 3/2885 181/243

(Continued)

FOREIGN PATENT DOCUMENTS

DE 13 00 130 B 9/1969
DE 38 15 148 A1 11/1989

(Continued)

OTHER PUBLICATIONS

DE-102013100454-A1 English Translation (Year: 2013).*

*Primary Examiner* — Anthony Ayala Delgado
(74) *Attorney, Agent, or Firm* — Walter Ottesen, P.A.

(57) ABSTRACT

An exhaust gas treatment assembly for an exhaust system of an internal combustion engine includes a housing having a circumferential wall and at least one base wall which in an external circumferential region is connected to the circumferential wall. In a housing interior space, which is defined by the circumferential wall and the base wall, at least one exhaust gas treatment unit is positioned so as to be removable from the housing. At least one base wall is an interchangeable base wall which is releasably connected to the circumferential wall via a connection assembly. The connection assembly includes a first connection portion, a first axial support portion, and on the base wall includes a second connection portion which via at least one connection member is releasably connected to the first connection portion and a second axial support portion is supported on the first axial support portion.

24 Claims, 1 Drawing Sheet

(56) References Cited

U.S. PATENT DOCUMENTS

| | | | | |
|---|---|---|---|---|
| 2011/0120085 | A1* | 5/2011 | Saito | F01N 13/1855 60/272 |
| 2017/0051655 | A1* | 2/2017 | Kauffmann | F01N 13/1872 |
| 2024/0318775 | A1* | 9/2024 | Conley | F16N 7/38 |

FOREIGN PATENT DOCUMENTS

| | | | | |
|---|---|---|---|---|
| DE | 42 13 822 | A1 | 10/1993 | |
| DE | 10 2008 032 766 | A1 | 3/2009 | |
| DE | 102013100454 | A1 * | 7/2014 | F01N 13/0097 |
| WO | 98/40610 | A1 | 9/1998 | |

* cited by examiner

EXHAUST GAS TREATMENT ASSEMBLY

CROSS REFERENCE TO RELATED APPLICATION

This application claims priority of German patent application no. 10 2021 130 261.7, filed Nov. 19, 2021, the entire content of which is incorporated herein by reference.

TECHNICAL FIELD

The present disclosure relates to an exhaust gas treatment assembly for an exhaust system of an internal combustion engine.

BACKGROUND

Above all in exhaust gas treatment units which are constructed for commercial motor vehicles or trucks, respectively, one or a plurality of exhaust gas treatment units which can be passed through by a flow of exhaust gas in parallel or in series are generally disposed in a housing. Exhaust gas treatment units of this type generally comprise a porous substrate, or a substrate configured with flow ducts, respectively, which is configured from catalytically effective material or/and coated with the latter and via a mounting mat constructed using fibrous material is received in a tubular sleeve. Since the effectiveness of this material can deteriorate over the service life of an exhaust gas treatment unit, in order to provide a sufficient reduction of the harmful substances contained in the exhaust gas it is necessary to replace either the exhaust gas treatment assemblies contained in exhaust systems, or the exhaust gas treatment units contained in exhaust gas treatment assemblies of this type. In particular when an exhaust gas treatment assembly of this type is constructed using a housing which defines the housing interior space that contains the exhaust gas treatment unit and which has a circumferential wall and base walls which at both ends are established on the circumferential wall by welding, access to the exhaust gas treatment units contained in the housing interior space is gained only in that one of the base walls is severed from the circumferential wall in a laborious procedure which is very complex, and the base wall is again established on the circumferential wall by welding after one or a plurality of depleted exhaust gas treatment units has/have been replaced.

SUMMARY

It is an object of the present disclosure to provide an exhaust gas treatment assembly for an exhaust system of an internal combustion engine in which one or a plurality of exhaust gas treatment units received in the exhaust gas treatment assembly can be easily replaced without the extensive use of tools and equipment.

This object is, for example, achieved by an exhaust gas treatment assembly for an exhaust system of an internal combustion engine, wherein the exhaust gas treatment assembly includes a housing having a circumferential wall which is elongate in the direction of a housing longitudinal axis, and at least one base wall which in an external circumferential region is connected to the circumferential wall; wherein in a housing interior space, which is defined by the circumferential wall and the at least one base wall, at least one exhaust gas treatment unit is positioned so as to be removable from the housing; wherein at least one base wall is an interchangeable base wall which via a connection assembly is releasably connected to the circumferential wall; wherein the connection assembly on the circumferential wall comprises a first connection portion which extends substantially in the direction of the housing longitudinal axis, and a first axial support portion which in terms of the first connection portion extends radially inward, and a first axial support portion which in terms of the first connection portion extends radially inward, and on the interchangeable base wall comprises a second connection portion which, radially adjacent to the first connection portion and preferably radially within the first connection portion, extends substantially in the direction of the housing longitudinal axis and via at least one connection member is releasably connected to the first connection portion, and a second axial support portion which in terms of the second connection portion extends radially inward and in the direction of the housing longitudinal axis is supported on the first axial support portion.

In the exhaust gas treatment assembly constructed according to the disclosure, it is ensured by the interaction of the two axial support portions that a defined positioning of the interchangeable base wall in the direction of the housing longitudinal axis is predefined, and therefore the interchangeable base wall upon carrying out a replacement of one or a plurality of exhaust gas treatment units can be easily disposed, practically without the use of tools, in a defined position on the circumferential wall. Once this positioning has been achieved, a fixed attachment of the interchangeable base wall to the circumferential wall can be generated by the use of generally a plurality of connection members, for example without a weld seam that guarantees a gas-tight closure also having to be generated to this end.

In order to be able to achieve a stable and ideally uniform connection between the circumferential wall and the interchangeable base wall across the entire circumference, it is proposed that the first connection portion or/and the second connection portion is/are configured so as to surround the housing longitudinal axis in an annular manner.

A plurality of first connection-member penetration openings which are disposed so as to be mutually spaced apart in the circumferential direction about the housing longitudinal axis or/and in the direction of the housing longitudinal axis can be provided in the first connection portion, and a plurality of second connection-member penetration openings which are disposed so as to be mutually spaced apart in the circumferential direction about the housing longitudinal axis or/and in the direction of the housing longitudinal axis can be provided in the second connection portion. In this way, in the case of an interchangeable base wall being connected to the circumferential wall, a plurality of pairs of in each case one first connection-member penetration opening and one second connection-member penetration opening can be provided, wherein for fixedly attaching the interchangeable base wall to the circumferential wall a plurality of these pairs, preferably each pair of this type, are in each case penetrated by one connection member.

A rapid connection of the interchangeable base wall to the circumferential wall, which nevertheless results in a stable attachment, can be achieved in that at least one connection member, preferably each connection member, comprises a threaded bolt, or/and that at least one connection member, preferably each connection member, comprises a rivet bolt. While the use of threaded bolts makes it possible for the latter to be repeatedly used, in the use of rivet bolts as connection members it is necessary for the latter to be destroyed in order for the connection to be released, this however not being associated with any damage to the structure of the connection portions connected as a result and in comparison to severing a completely encircling weld seam being an operating procedure which can be carried out in a substantially simpler and more rapid manner.

The first axial support portion can be configured so as to be annular such that the first axial support portion by way of the annular structure thereof covers the interchangeable base wall substantially only in the radially outer region of the latter.

In order to maintain a gas-tight closure of the housing interior space, the first axial support portion, in a first transition region which provides a sealing element receptacle molding, can adjoin the first connection portion. A sealing element which surrounds the housing longitudinal axis in an annular manner can be disposed in the sealing element receptacle molding, the interchangeable base wall, while compressing the sealing element, being able to be supported on the latter in particular in the direction of the housing longitudinal axis.

In order to be able to construct the connection assembly independently of the circumferential wall of the housing, the connection assembly can comprise a connection element which is established on the circumferential wall and provides the first connection portion and the first axial support portion, the connection element in terms of the housing longitudinal axis potentially having an L-shaped longitudinal sectional structure, for example.

In a construction which is easy to implement but is nevertheless stable and resistant to exhaust gas, the connection element can be configured as a formed sheet metal part. For a stable connection between the connection element and the circumferential wall it is proposed that the connection element by way of part of the first connection portion and the first axial support portion is inserted in an axial end region of the circumferential wall, or/and that the connection element is connected to the circumferential wall by a materially integral connection, preferably by welding or soldering/brazing.

The second axial support portion can be provided by a radially outer portion of a base region of the interchangeable base wall. For a stable supporting interaction here, the radially outer portion of the base region can be disposed so as to extend in a substantially radial manner. In order to be able to close the housing interior space in the direction of the housing longitudinal axis via the interchangeable base wall in the case of a defined flow routing, a portion of the base region that adjoins the radially outer portion of the base region can preferably be configured so as to be domed in the direction away from the housing interior space.

The second axial support portion in a second transition region can adjoin the second connection portion, the second transition portion comprising a transition portion which extends substantially in the direction of the housing longitudinal axis and in terms of the second connection portion is radially offset, preferably radially inward, at a radial spacing from the first connection portion. This embodiment is particularly advantageous above all when the transition portion is positioned in that axial region in which the connection element that provides the first connection portion and the first axial support portion is connected to the circumferential wall, for example by welding. Minor variances in terms of shape which may have been introduced as a result of welding can thus not lead to the positioning of the interchangeable base wall being compromised.

For a construction which is easy to implement, the second connection portion and the second axial support portion can be provided on a first base element of the interchangeable base wall.

Furthermore, the first base element can be configured as a formed sheet metal part. In order to achieve thermal shielding in relation to the comparatively hot exhaust gases flowing in the housing interior space in the region of the interchangeable base wall, a second base element, which conjointly with the first base element delimits an insulation volume preferably filled with insulation material, can be disposed on a side of the second axial support portion that faces away from the housing interior space.

When the second base element is connected to the first base element in the region of the transition portion, the exact positioning capability of the interchangeable base wall is also not compromised as a result of this connection.

For defined positioning of one or a plurality of exhaust gas treatment units in the housing interior space, at least one partition wall, preferably a plurality of partition walls which are successively disposed in the direction of the housing longitudinal axis, can be provided in the housing interior space, at least one partition wall, preferably each partition wall, so as to be assigned to at least one exhaust gas treatment unit, preferably to each exhaust gas treatment unit, having an exhaust gas treatment unit penetration opening which is penetrated by an exhaust gas treatment unit, or/and at least one exhaust gas treatment unit, preferably each exhaust gas treatment unit, being releasably established on at least one partition wall, preferably the partition wall positioned closest to the interchangeable base wall.

The disclosure furthermore relates to an exhaust system for an internal combustion engine, for example in a passenger motor vehicle, a commercial motor vehicle or a truck, having at least one exhaust gas treatment assembly constructed according to the disclosure.

BRIEF DESCRIPTION OF THE DRAWINGS

The invention will now be described with reference to the drawings wherein.

DESCRIPTION OF THE PREFERRED EMBODIMENTS

Figure 1:
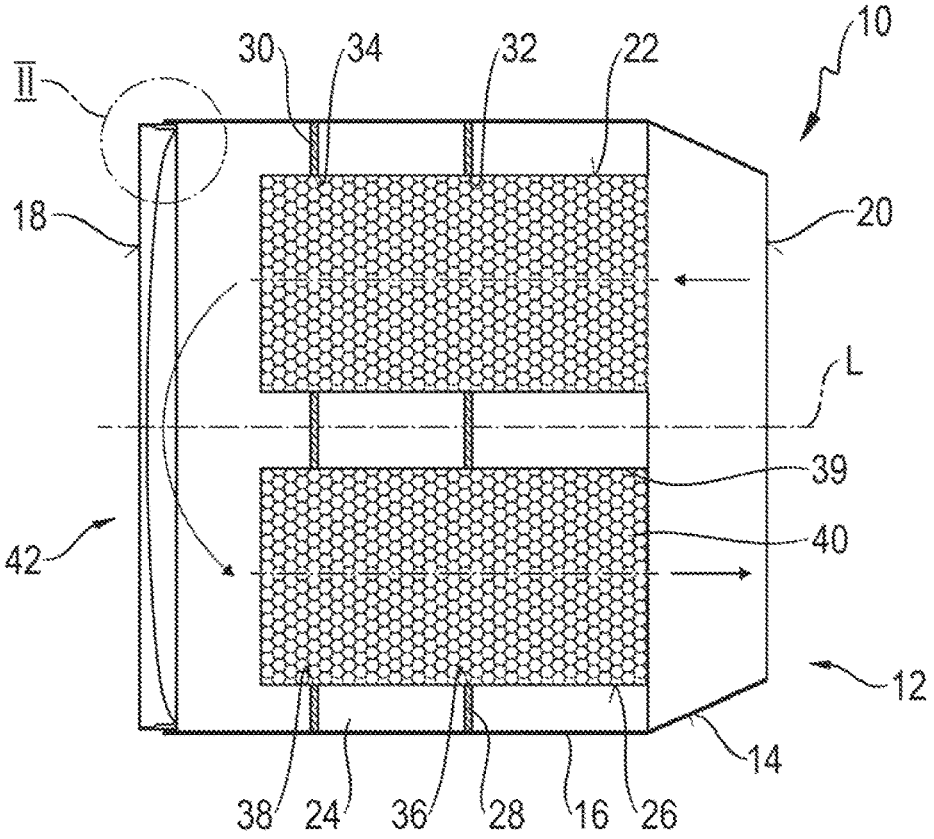
FIG. 1 shows an exhaust gas treatment assembly for an exhaust system of an internal combustion engine, in a schematic longitudinal sectional illustration; and, FIG. 2 shows the detail II of FIG. 1 in an enlarged schematic illustration.

An exhaust gas treatment assembly shown in a schematic longitudinal sectional illustration in FIG. 1 is generally designated by the reference sign 10. This exhaust gas treatment assembly 10 can provide part of an exhaust system, generally designated by the reference sign 12, of an internal combustion engine in a vehicle, and comprises a housing 14 which is elongate in the direction of a housing longitudinal axis L and has a substantially cylindrical circumferential wall 16 that surrounds the housing longitudinal axis L, for example, and at both axial end regions of the circumferential wall 16 has in each case one base wall 18 or 20, respectively. In the embodiment of the exhaust gas treatment assembly 10 illustrated, the exhaust gas emitted by an internal combustion engine can flow in the direction to a first exhaust gas treatment unit 22 through an opening configured in the base wall 20, for example, and in the housing interior space 24 of the housing 14 through the exhaust gas treatment unit 22. The exhaust gas exiting the first exhaust gas treatment unit 22 close to the base wall 18 is deflected by the base wall 18 and makes its way into the region of a second exhaust gas treatment unit 26. After flowing through also the second exhaust gas treatment unit 26, the exhaust gas treated in the exhaust gas treatment assembly 10 can depart the exhaust gas treatment assembly 10 by way of an opening configured in the base wall 20 and flow to further system regions of the exhaust system 12.

The two exhaust gas treatment units 22, 26 are supported on the housing 14 by partition walls 28, 30 which in the housing interior space 24 are disposed at a mutual axial spacing. Each of the partition walls 28, 30, so as to be assigned to each of the exhaust gas treatment units 22, 26, can have an exhaust gas treatment unit penetration opening 32, 34, 36, 38, the latter being penetrated by a respective exhaust gas treatment unit 22 or 26, respectively.

Each of the exhaust gas treatment units 22, 26 can be configured as a so-called cartridge and comprise a substantially cylindrical or sleeve-type housing 39, respectively, having therein a, for example, monolithic substrate 40 which is supported for example while using a fibrous mat or the like. This substrate 40 is generally constructed so as to have a porous structure, thus a structure through which exhaust gas can flow, and at least on the surface thereof which interacts with the exhaust gas is constructed using a catalytically effective material. For example, an exhaust gas treatment unit of this type can be constructed, or be effective, respectively, as a particle filter, an oxidation catalytic converter, or an SCR catalytic converter.

In the construction of an exhaust gas treatment assembly 10 illustrated in FIG. 1, the base wall 20 illustrated on the right, for example, can be fixedly connected to the circumferential wall 16 by welding, for example. The base wall 18 illustrated on the left in FIG. 1 can be an interchangeable base wall 42 which in the manner described hereunder can be comparatively easily removed from the housing 14, or from the circumferential wall 16 of the latter, respectively, so as to in this way attain access to the housing interior space 24 and the exhaust gas treatment units 22, 26 disposed therein. In this way, upon removal of the interchangeable base wall 42, there is the possibility of retrieving one or both of the exhaust gas treatment units 22, 26 from the housing interior space 24 and of replacing the latter by a new exhaust gas treatment assembly 10 which is not depleted and is thus more effective in terms of reducing the proportion of harmful substances in the exhaust gas. To this end, the exhaust gas treatment units 22, 26, for example in the region of the partition wall 30 that is positioned closest to the interchangeable base wall 42, can be releasably established by screw-fitting or the like, such that the exhaust gas treatment units 22, 26 can be retrieved by simply releasing a connection of this type without the extensive use of tools, or can be disposed again in the same manner in a stable and defined positioning in the housing interior space 24, respectively.

Figure 2:
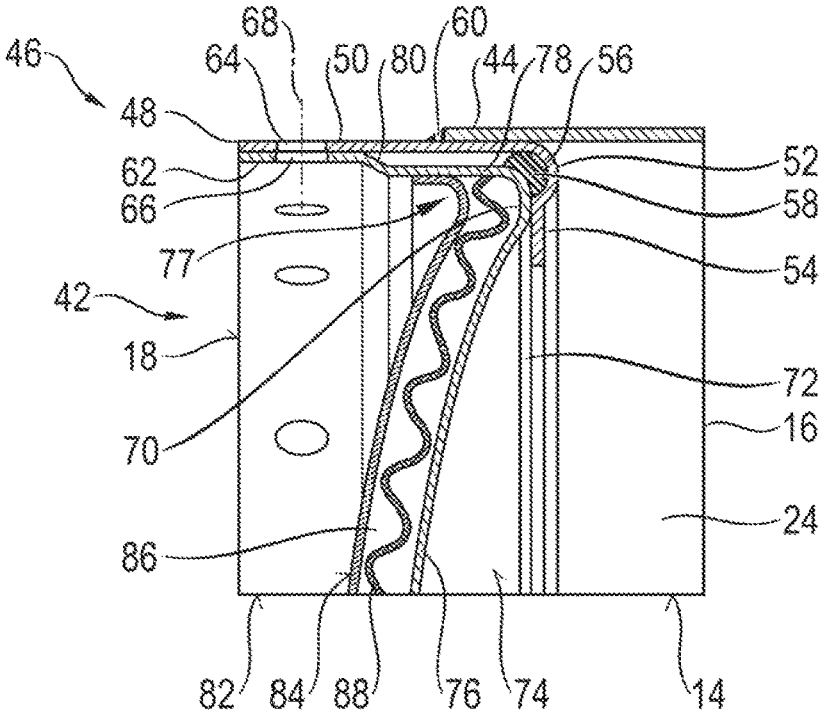

Before the construction of the exhaust gas treatment assembly 10, in particular in terms of the interchangeable base wall 42, is described hereunder in more detail with reference to FIG. 2, it is to be pointed out that the fundamental construction of the exhaust gas treatment assembly 10 illustrated in FIG. 1 and described above, in terms of the disposal of one or a plurality of exhaust gas treatment units 22, 26 therein, is to be considered only exemplarily. In an alternative embodiment, the two exhaust gas treatment units 22, 26 could be passed through in parallel by a flow of the exhaust gas to be treated such that the exhaust gas, for example by way of the base wall 20, flows in the direction to the two exhaust gas treatment units 22, 26 and after flowing through the latter exits the housing interior space 24 by way of an opening not illustrated in FIG. 1. Also, more than two exhaust gas treatment units could be provided, or a single exhaust gas treatment unit could be provided. The two exhaust gas treatment units 22, 26 could also be disposed successively in the direction of the housing longitudinal axis L. For example, the exhaust gas treatment unit that is more remote from the interchangeable base wall 42 here could be held on the housing 14 by the exhaust gas treatment unit that lies closer to the interchangeable base wall 42, while the exhaust gas treatment unit lying closer to the interchangeable base wall 42 can be releasably established, in the manner described above, for example by screw-fitting or the like, on the partition wall positioned closest to the interchangeable base wall 42.

FIG. 2 shows an axial end region 44 of the circumferential wall 16 of the housing 14. In the region of this axial end region 44, the interchangeable base wall 42 is releasably connected to the circumferential wall 16 via a connection assembly generally designated by the reference sign 46.

The connection assembly 46 comprises a connection element 48 which is configured, for example, as a formed sheet metal part and surrounds the housing longitudinal axis L in an annular manner. The connection element 48, by way of a substantially cylindrical region that extends in the direction of the housing longitudinal axis L, provides a first connection portion 50. In a first transition region 52, a first axial support portion 54 of the connection element 48, or of the connection assembly 46, respectively, adjoins the first connection portion 50. The first axial support portion 54 extends substantially in the radial direction toward the housing longitudinal axis L and is constructed using a preferably annular structure such that a stable, defined axial support for the interchangeable base wall 42 can be achieved across the entire circumference of the housing 14.

The first transition region 52 forms a sealing element receptacle molding 56 which in the direction toward the housing interior space 24 projects beyond the first axial support portion 54. Received in the sealing element receptacle molding 56 is a sealing element 58 which is configured, for example, as an O-ring and completely surrounds the housing longitudinal axis L, the sealing element 58 in this way also being held in a defined position in a radially inward manner.

The connection element 48 by way of part of the first connection portion 50 thereof, the first transition region 52 and the first axial support portion 54, is introduced into the axial end region 44 of the circumferential wall 16. The connection element 48, by a weld seam 60 which is preferably encircling in the circumferential direction, is attached in a stable and gas-tight manner to the circumferential wall 16.

The connection assembly 46 on the interchangeable base wall 42 comprises a second connection portion 62 which extends in the direction of the housing longitudinal axis L and is configured so as to be substantially cylindrical and surrounds the housing longitudinal axis L. The second connection portion 62 is positioned radially within the first connection portion 50 and can be of such a dimension, for example, that ideally little radial play is present between the first connection portion 50 and the second connection portion 62.

The first connection portion 50 and the second connection portion 62, in longitudinal portions thereof that mutually overlap axially and in the circumferential direction, have respective first connection-member penetration openings 64, or second connection-member penetration openings 66, respectively. For example, the disposal can be in such a manner that the first connection-member penetration openings 64 in the first connection portion 50 are disposed in the circumferential direction about the housing longitudinal axis L and so as to be successive at a preferably substantially identical mutual spacing, and the second connection-member penetration openings 66 in the second connection portion 62 of the interchangeable base wall 42 are also disposed by way of the same pattern of disposal, so as to be successive in an annular structure about the housing longitudinal axis L. In this way, pairs of first connection-member penetration openings 64 and second connection-member penetration openings 66, which are disposed so as to mutually overlap and through which connection members 68 which are only indicated schematically for establishing the interchangeable base wall 42 can be guided, are in each case formed. For example, the connection members 68 can be configured as threaded bolts which can be fixed while using assigned nuts, thus guaranteeing a stable, releasable mounting of the interchangeable base wall 42 on the connection element 48 and by way of the latter on the circumferential wall 16. Alternatively, connection members 68 of this type can be configured as rivet bolts or other fixing pins which can be attached and also removed again in a comparatively simple manner and without the extensive use of tools and in particular also without damage to the two connection portions 50, 62.

The interchangeable base wall 42 which in the axial direction closes off the housing interior space 24, so as to be assigned to the first axial support portion 54 of the connection element, has a second axial support portion 70. The latter is provided by a radially outer portion 72 of a base region of the interchangeable base wall 42 that is generally designated by the reference sign 74. The base region 74 of the interchangeable base wall 42, by way of the radially outer portion 72 that provides the second axial support portion 70, extends substantially in the radial direction, in a radially inward manner, such that a planar bearing contact between the first axial support portion 54 of the connection element 48 and the second axial support portion 70 of the interchangeable base wall 42 is guaranteed.

The radially outer portion 72 of the base region 74 is adjoined by a portion 76 of the base region 74, which is domed in the direction outwardly away from the housing interior space 24 and which guarantees a defined deflection of the exhaust gases which are to flow onto this portion 76.

The radially outer portion 72 of the base region 74, which provides the second axial support portion 70, in a second transition region 77 transitions to the second connection portion 62 of the connection assembly 46. The second transition region 77 comprises a transition portion 78 which is elongate in the direction of the housing longitudinal axis L, is substantially cylindrical and surrounds the housing longitudinal axis L in an annular manner and which, like the second connection portion 62, is positioned radially within the first connection portion 50 of the connection element 48 but has an axial spacing from the latter. This means that the transition portion 78 in terms of the second connection portion 62 is disposed so as to be offset in a radially inward manner and, in a step-like or conical transition region 80, transitions to the connection portion 62.

It can be seen in FIG. 2 that the transition portion 78, which is disposed at a radial spacing from the first connection portion 50, in the axial direction away from the housing interior space 24 extends beyond that region in which the connection element 48 is attached to the circumferential wall 16 by the weld seam 60. Minor variances in terms of shape, in particular on the connection element 48, which could potentially be created by the generation of the weld seam 60, thus do not compromise the positioning capability of the interchangeable base wall 42 in the connection element 48. Rather, the latter by way of the end region, which is provided by the second transition region 77 and in radial terms is of a somewhat smaller dimension, leading can be introduced into the connection element 48 until the interchangeable base wall 42 first comes to bear on the sealing element 58 and, after the compression of the latter, by way of the second axial support portion 70 of the end region comes to bear on the first axial support portion 54 of the connection element 48.

In this state, the first connection-member penetration openings 64 and second connection-member penetration openings 66 also lie in the same axial region such that a circumferential alignment of the connection-member penetration openings 64, 66 can optionally also be initiated by rotating the interchangeable base wall 42 about the housing longitudinal axis L, before the connection members 68 are guided through the connection-member penetration openings 64, 66 and the interchangeable base wall 42 in this manner is releasably attached to the connection element 48 and thus also releasably attached to the circumferential wall 16. In this state, the housing interior space 24 is closed off in a gas-tight manner by the interchangeable base wall 42 and in particular also by the sealing element 58. Owing to the fact that the second axial support portion 70 radially within the sealing element 58 in the circumferential direction bears on the first axial support portion 54 preferably without interruption, the sealing element 58 is shielded in relation to the inflow of exhaust gas and thus protected in relation to excessive thermal and chemical stress. Since the connection element 48 by way of the generally L-shaped profile thereof in the region of the first axial support portion 54 engages in a radially inward manner only to a comparatively minor extent and only slightly radially engages across the domed portion 76 of the base region 74, and in the case of being correspondingly dimensioned does not radially engage across the latter at all, the function of the domed portion 76 of the base region 74 is not compromised in terms of a defined deflection of the flow.

In order to keep thermal losses to the outside as low as possible, a second base element 84, which can likewise be configured as a formed sheet metal part, for example, is provided on a first base element 82 of the interchangeable base wall 42, the first base element 82 providing substantially the base region 74 having the two portions 72, 76 thereof, the second transition region 77 and the second connection portion 62 and being configured as a formed sheet metal part, for example, the second base element 84 in terms of the shape thereof being configured so as to be domed and adapted to the base region 74. The second base element 84, radially on the outside in the region of the transition portion 78, is attached to the first base element 82 by welding, for example. The second base element 84, conjointly with the first base element 82, delimits an insulation volume 86 in which fibrous or foamed thermal insulation material 88 can be received, for example. It is guaranteed in this manner that the exhaust gas, which in the deflection of the flow intensively interacts thermally with the base region 74, dissipates comparatively little heat in the region of the interchangeable base wall 42 such that system regions of the exhaust gas treatment assembly 10, or of the exhaust system 12, which are further downstream in the flow direction are impinged by sufficiently hot exhaust gas and in this way can be kept at the operating temperature, or can be rapidly brought to the operating temperature, respectively.

With the construction of an exhaust gas treatment assembly according to the disclosure, the possibility of removing a base wall of a housing of an exhaust gas treatment unit in a simple manner and while using tools of a comparatively simple configuration and attaching the base wall thereto again is achieved, such that operating procedures for changing one or a plurality of exhaust gas treatment units disposed in the housing can be carried out easily and also in workshops not specialized in this field, or not equipped with special tools, respectively.

It is understood that the foregoing description is that of the preferred embodiments of the invention and that various changes and modifications may be made thereto without departing from the spirit and scope of the invention as defined in the appended claims.

What is claimed is:

1. An exhaust gas treatment assembly for an exhaust system of an internal combustion engine, the exhaust gas treatment assembly comprising:

a housing having a circumferential wall and at least one base wall;

said circumferential wall being elongate in the direction of a housing longitudinal axis;

said at least one base wall being, in an external circumferential region, connected to said circumferential wall;

said circumferential wall and said at least one base wall defining a housing interior space;

at least one exhaust gas treatment unit positioned so as to be removable from said housing;

said at least one base wall being an interchangeable base wall which is releasably connected to said circumferential wall via a connection assembly;

said connection assembly, on said circumferential wall, including a first connection portion extending in a direction of the housing longitudinal axis and a first axial support portion which, in relation to said first connection portion, extends radially inward; and, said connection assembly, on said interchangeable base wall, including a second connection portion which, radially adjacent to and axially overlapping said first connection portion, extends in the direction of the housing longitudinal axis, said axially overlapping first and second connection portions being releasably connected to each other by a plurality of connection members, and a second axial support portion which, in relation to said second connection portion, extends radially inward and in the direction of the housing longitudinal axis is supported on said first axial support portion.

2. The exhaust gas treatment assembly of claim 1, wherein at least one of said first connection portion and said second connection portion is configured so as to surround the housing longitudinal axis in an annular manner.

3. The exhaust gas treatment assembly of claim 1, wherein:

a plurality of first connection-member penetration openings are provided in said first connection portion, said plurality of first connection-member penetration openings being disposed so as to be mutually spaced apart in at least one of the circumferential direction about the housing longitudinal axis and the direction of the housing longitudinal axis;

a plurality of second connection-member penetration openings are provided in said second connection portion, said plurality of second connection-member penetration openings being disposed so as to be mutually spaced apart in at least one of the circumferential direction about the housing longitudinal axis and the direction of the housing longitudinal axis; and, when said interchangeable base wall is connected to said circumferential wall, a plurality of pairs of in each case one of said first connection-member penetration openings and one of said second connection-member penetration openings are in each case penetrated by one of said at least one connection members.

4. The exhaust gas treatment assembly of claim 1, wherein at least one of said plurality of connection members includes at least one of a threaded bolt and a rivet bolt.

5. The exhaust gas treatment assembly of claim 1, wherein each of said plurality of connection members includes at least one of a threaded bolt and a rivet bolt.

6. The exhaust gas treatment assembly of claim 1, wherein said first axial support portion is configured to be annular.

7. The exhaust gas treatment assembly of claim 1, wherein said first axial support portion, in a first transition region providing a sealing element receptacle molding, adjoins said first connection portion, a sealing element which surrounds the housing longitudinal axis in an annular manner being disposed in said sealing element receptacle molding.

8. The exhaust gas treatment assembly of claim 1, wherein said connection assembly includes a connection element which is fixed on said circumferential wall and provides said first connection portion and said first axial support portion.

9. The exhaust gas treatment assembly of claim 8, wherein at least one of:

said connection element is configured as a formed sheet metal part;

said connection element has an L-shaped longitudinal sectional structure;

said connection element by way of part of said first connection portion and said first axial support portion is inserted in an axial end region of said circumferential wall; and, said connection element is connected to said circumferential wall by a materially integral connection.

10. The exhaust gas treatment assembly of claim 1, wherein said second axial support portion is provided by a radially outer portion of a base region of said interchangeable base wall.

11. The exhaust gas treatment assembly of claim 10, wherein at least one of:

said radially outer portion of said base region is disposed so as to extend in a substantially radial manner; and, a portion of said base region adjoining said radially outer portion of said base region is configured so as to be domed in a direction away from said housing interior space.

12. The exhaust gas treatment assembly of claim 1, wherein said second axial support portion in a second transition region adjoins said second connection portion; and, said second transition region includes a transition portion extending in the direction of the housing longitudinal axis and in relation to said second connection portion is radially offset at a radial spacing from said first connection portion.

13. The exhaust gas treatment assembly of claim 12, wherein said second connection portion is radially offset inwardly.

14. The exhaust gas treatment assembly of claim 1, wherein said second connection portion and said second axial support portion are provided on a first base element of said interchangeable base wall.

15. The exhaust gas treatment assembly of claim 14, wherein at least one of:

said first base element is a formed sheet metal part; and, a second base element, which conjointly with the first base element delimits an insulation volume is disposed on a side of said second axial support portion facing away from said housing interior space.

16. The exhaust gas treatment assembly of claim 14, wherein a second base element, which conjointly with the first base element delimits an insulation volume filled with insulation material is disposed on a side of said second axial support portion facing away from said housing interior space.

17. The exhaust gas treatment assembly of claim 15, wherein said second axial support portion in a second transition region adjoins said second connection portion; said second transition region includes a transition portion extending in the direction of the housing longitudinal axis and in relation to said second connection portion is radially offset at a radial spacing from said first connection portion; and, said second base element in a region of said transition portion is connected to said first base element.

18. The exhaust gas treatment assembly of claim 1 further comprising:

at least one partition wall provided in said housing interior space;

wherein at least one of:

said at least one partition wall, so as to be assigned to at least one exhaust gas treatment unit, having an exhaust gas treatment unit penetration opening configured to be penetrated by at least one exhaust gas treatment unit; and, at least one exhaust gas treatment unit being releasably established on at least one of said at least one partition wall.

19. The exhaust gas treatment assembly of claim 1 further comprising:

a plurality of partition walls provided in said housing interior space which are successively disposed in a direction of the housing longitudinal axis;

wherein at least one of:

each of said plurality of partition walls, so as to be assigned to each exhaust gas treatment unit, having an exhaust gas treatment unit penetration opening configured to be penetrated by at least one exhaust gas treatment unit; and, each of said exhaust gas treatment units being releasably established on at least one of said plurality of partition walls positioned closest to said interchangeable base wall.

20. An exhaust system for an internal combustion engine, comprising the exhaust gas treatment assembly of claim 1.

21. An exhaust gas treatment assembly for an exhaust system of an internal combustion engine, the exhaust gas treatment assembly comprising:

a housing having a circumferential wall and at least one base wall;

said circumferential wall being elongate in the direction of a housing longitudinal axis;

said at least one base wall being, in an external circumferential region, connected to said circumferential wall;

said circumferential wall and said at least one base wall defining a housing interior space;

at least one exhaust gas treatment unit positioned so as to be removable from said housing;

said at least one base wall being an interchangeable base wall which is releasably connected to said circumferential wall via a connection assembly;

said connection assembly, on said circumferential wall, including a first connection portion extending in a direction of the housing longitudinal axis and a first axial support portion which, in relation to said first connection portion, extends radially inward; and, said connection assembly, on said interchangeable base wall, including a second connection portion which, radially adjacent to said first connection portion, extends in the direction of the housing longitudinal axis and is releasably connected to said first connection portion via at least one connection member, and a second axial support portion which, in relation to said second connection portion, extends radially inward and in the direction of the housing longitudinal axis is supported on said first axial support portion; wherein:

a plurality of first connection-member penetration openings are provided in said first connection portion, said plurality of first connection-member penetration openings being disposed so as to be mutually spaced apart in at least one of the circumferential direction about the housing longitudinal axis and the direction of the housing longitudinal axis;

a plurality of second connection-member penetration openings are provided in said second connection portion, said plurality of second connection-member penetration openings being disposed so as to be mutually spaced apart in at least one of the circumferential direction about the housing longitudinal axis and the direction of the housing longitudinal axis; and, when said interchangeable base wall is connected to said circumferential wall, a plurality of pairs of in each case one of said first connection-member penetration openings and one of said second connection-member penetration openings are in each case penetrated by one of said at least one connection members.

22. An exhaust gas treatment assembly for an exhaust system of an internal combustion engine, the exhaust gas treatment assembly comprising:

a housing having a circumferential wall and at least one base wall;

said circumferential wall being elongate in the direction of a housing longitudinal axis;

said at least one base wall being, in an external circumferential region, connected to said circumferential wall;

said circumferential wall and said at least one base wall defining a housing interior space;

at least one exhaust gas treatment unit positioned so as to be removable from said housing;

said at least one base wall being an interchangeable base wall which is releasably connected to said circumferential wall via a connection assembly;

said connection assembly, on said circumferential wall, including a first connection portion extending in a direction of the housing longitudinal axis and a first axial support portion which, in relation to said first connection portion, extends radially inward; and, said connection assembly, on said interchangeable base wall, including a second connection portion which, radially adjacent to said first connection portion, extends in the direction of the housing longitudinal axis and is releasably connected to said first connection portion via at least one connection member, and a second axial support portion which, in relation to said second connection portion, extends radially inward and in the direction of the housing longitudinal axis is supported on said first axial support portion;

wherein said second axial support portion in a second transition region adjoins said second connection portion; and, said second transition region includes a transition portion extending in the direction of the housing longitudinal axis and in relation to said second connection portion is radially offset at a radial spacing from said first connection portion.

23. An exhaust gas treatment assembly for an exhaust system of an internal combustion engine, the exhaust gas treatment assembly comprising:

a housing having a circumferential wall and at least one base wall;

said circumferential wall being elongate in the direction of a housing longitudinal axis;

said at least one base wall being, in an external circumferential region, connected to said circumferential wall;

said circumferential wall and said at least one base wall defining a housing interior space;

at least one exhaust gas treatment unit positioned so as to be removable from said housing;

said at least one base wall being an interchangeable base wall which is releasably connected to said circumferential wall via a connection assembly;

said connection assembly, on said circumferential wall, including a first connection portion extending in a direction of the housing longitudinal axis and a first axial support portion which, in relation to said first connection portion, extends radially inward; and, said connection assembly, on said interchangeable base wall, including a second connection portion which, radially adjacent to said first connection portion, extends in the direction of the housing longitudinal axis and is releasably connected to said first connection portion via at least one connection member, and a second axial support portion which, in relation to said second connection portion, extends radially inward and in the direction of the housing longitudinal axis is supported on said first axial support portion; wherein:

said second connection portion and said second axial support portion are provided on a first base element of said interchangeable base wall; and a second base element, which conjointly with the first base element delimits an insulation volume filled with insulation material is disposed on a side of said second axial support portion facing away from said housing interior space.

24. An exhaust gas treatment assembly for an exhaust system of an internal combustion engine, the exhaust gas treatment assembly comprising:

a housing having a circumferential wall and at least one base wall;

said circumferential wall being elongate in the direction of a housing longitudinal axis;

said at least one base wall being, in an external circumferential region, connected to said circumferential wall;

said circumferential wall and said at least one base wall defining a housing interior space;

at least one exhaust gas treatment unit positioned so as to be removable from said housing;

said at least one base wall being an interchangeable base wall which is releasably connected to said circumferential wall via a connection assembly;

said connection assembly, on said circumferential wall, including a first connection portion extending in a direction of the housing longitudinal axis and a first axial support portion which, in relation to said first connection portion, extends radially inward; and, said connection assembly, on said interchangeable base wall, including a second connection portion which, radially adjacent to said first connection portion, extends in the direction of the housing longitudinal axis and is releasably connected to said first connection portion via at least one connection member, and a second axial support portion which, in relation to said second connection portion, extends radially inward and in the direction of the housing longitudinal axis is supported on said first axial support portion; wherein:

said second connection portion and said second axial support portion are provided on a first base element of said interchangeable base wall;

a second base element, which conjointly with the first base element delimits an insulation volume is disposed on a side of said second axial support portion facing away from said housing interior space; and said second axial support portion in a second transition region adjoins said second connection portion; said second transition region includes a transition portion extending in the direction of the housing longitudinal axis and in relation to said second connection portion is radially offset at a radial spacing from said first connection portion; and, said second base element in a region of said transition portion is connected to said first base element.

* * * * *